United States Patent [19]

Cohen et al.

[11] 3,951,197

[45] Apr. 20, 1976

[54] DRAPERY-SUPPORTING SYSTEM AND COMPONENTS THEREOF

[75] Inventors: Seymour Cohen, Plainview; Norman Klar, Brooklyn; Alfred Cassell, West Hempstead, all of N.Y.

[73] Assignee: Master Recessed Systems, Inc., Plainview, N.Y.

[22] Filed: Dec. 18, 1973

[21] Appl. No.: 425,810

[52] U.S. Cl. ..... 160/346; 16/87.6 R

[51] Int. Cl.[2] ..... A47H 5/032

[58] Field of Search ..... 160/344, 345, 346, 347, 160/123, 124, 126; 16/87, 87.2, 87.4, 87.6, 87.8

[56] References Cited

UNITED STATES PATENTS

| | | | |
|---|---|---|---|
| 2,589,585 | 3/1952 | Tomastik | 16/87.6 R |
| 3,192,996 | 7/1965 | Greenstadt et al. | 160/345 |
| 3,354,498 | 11/1967 | Salzmann | 160/345 X |
| 3,503,434 | 3/1970 | Ford | 160/345 |
| 3,555,750 | 6/1968 | Banse | 160/345 X |
| 3,693,696 | 9/1972 | Salzmann | 160/345 |
| 3,708,927 | 1/1973 | Cohen | 160/345 X |
| 3,738,414 | 6/1973 | Baker, Sr. | 160/345 |

*Primary Examiner*—Philip C. Kannan
*Attorney, Agent, or Firm*—Steinberg and Blake

[57] ABSTRACT

A drapery-supporting system where a track has a front portion supporting a plurality of carriers one of which is a master carrier, the track having a rear cord portion receiving part of the master carrier which is guided for movement along the rear cord portion. A control cord which extends along the rear cord portion is connected to the master carrier and extends around pulleys at the end of the track so that by moving the cord the master carrier can be moved along the track. An elongated flexible cord interconnects all of the carriers, and one of the carriers is an end carrier which is fixed so that by moving the control cord connected to the master carrier a drape supported by the carriers can be moved between open and closed positions. At the end of the track where the end carrier is located, a pulley assembly is provided for the control cord and has a swingable gate enabling carriers to be introduced into and removed from the track with the end carrier held stationary by this gate.

8 Claims, 18 Drawing Figures

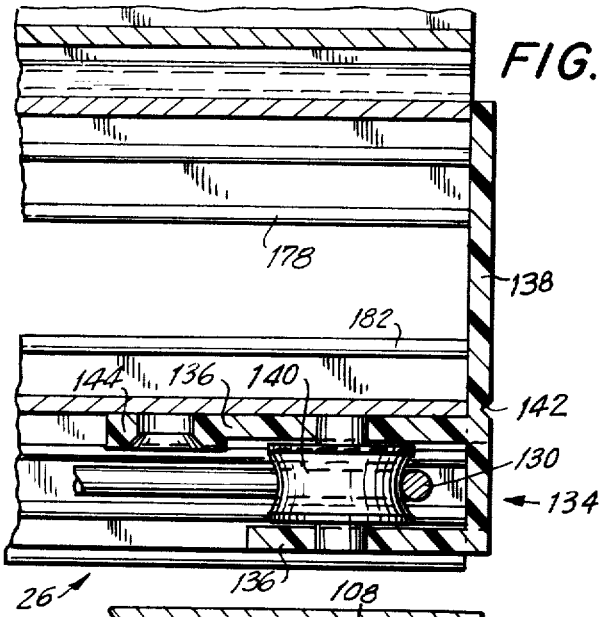
FIG. 8
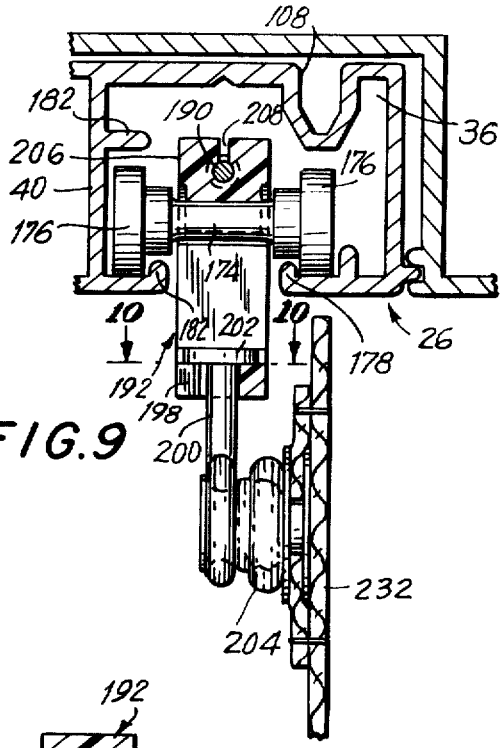
FIG. 9
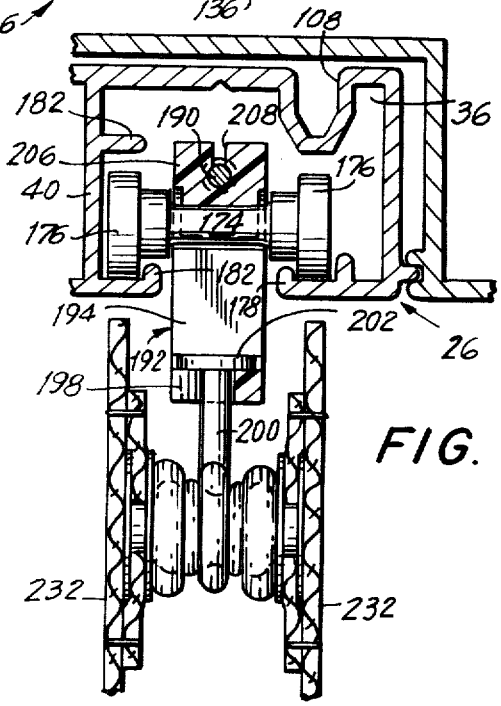
FIG. 11
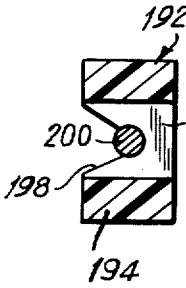
FIG. 10
FIG. 12
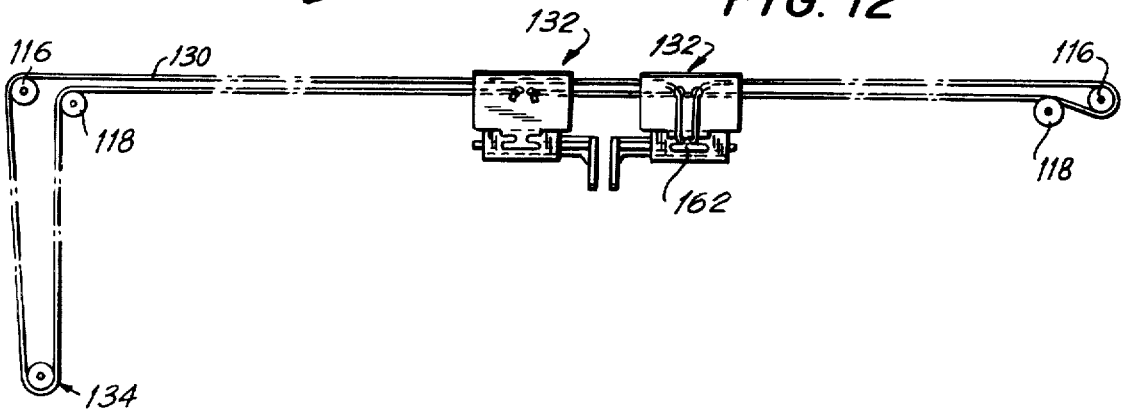

DRAPERY-SUPPORTING SYSTEM AND COMPONENTS THEREOF

BACKGROUND OF THE INVENTION

The present invention relates to drapery-supporting systems and to components thereof.

It is customary to situate along the upper part of a window frame a drapery supporting system from which one or more drapes to cover a window are suspended in such a way that the drapes can be moved to a closed position covering the window or an open position uncovering the window. The conventional drapery supporting systems are relatively complex and expensive. They are difficult to assemble and are difficult to convert between a single drape system and a double drape system. The manner in which cords are guided is relatively complex and the manner in which components which support the drape are moved toward and away from each other is not satisfactory with conventional constructions. Thus the carriers which directly carry the drape often jam and do not permit the drape to be easily moved between the open and closed positions. In a center opening drapery system it is difficult to join the ends of the pair of drapes precisely at the center of the window, and in this case also the drape is connected to the system only with difficulty and a relatively large number of complex expensive components are required with conventional systems, these components being difficult to mount and to assemble together.

SUMMARY OF THE INVENTION

It is accordingly a primary object of the present invention to provide a drapery supporting system which will avoid the above drawbacks.

In particular, it is an object of the present invention to provide a drapery-supporting system which is extremely easy to install.

Also it is an object of the present invention to provide a drapery supporting system which operates reliably and easily in order to move drapes between open and closed position.

Furthermore it is an object of the present invention to provide a drapery-supporting system which can easily be converted from a single drape system to a double drape system or from a double drape system to a single drape system.

Furthermore it is an object of the present invention to provide a system of this type which is composed of relatively simple rugged components which are inexpensive and which can readily be assembled into the system.

Furthermore it is an object of the present invention to provide a system of the above type which easily lends itself to addition or removal of drapery carrying elements so that the number of elements which move along a track of the system and which carry the drape can be controlled at will in a highly convenient manner.

Furthermore it is an object of the present invention to provide a system of this type with components many of which can be used at different parts of the system so that the number of components required by the entire system is relatively small as compared to conventional systems.

In addition it is an object of the invention to provide a drapery system which makes it possible to assemble and dissassemble components without the use of tools.

Yet another object of the present invention is to provide a drapery system in which most of the components are formed of plastic bodies and where metal is used, extruded light metal, so that all of the components of the drapery system of the invention are inexpensive and are light in weight.

Yet another object of the present invention is to provide a drapery circuiting system where the carriers which are connected to the tops of the drapes are adapted to receive various types of fasteners so that the drapery system does not require special fasteners for the drapes.

In accordance with the invention the drapery circuiting system includes an elongated channel means having a hollow interior adapted to be directed downwardly. An elongated track means is removably carried by the elongated channel means and extends into the hollow interior thereof, this elongated track means having a front longitudinally extending carrier portion formed at its lower region with a longitudinally extending opening and a rear cord portion extending behind the carrier portion and also having a hollow interior, the track means including a wall which separates the front carrier portion from the rear cord portion thereof. A plurality of carrier means are situated in the carrier portion of the track means circuited therein for free movement longitudinally along the track means, each carrier means, having a portion extending through the opening at the lower region of the carrier portion of the track means and carrying below the track means a connecting means for connecting drapery to the carrier means. The plurality of carrier means including at least one end carrier means which is stationary and located at an end of the track means and at least one opposed master carrier means distant from the end carrier means with at least one additional carrier means located between the end and master carrier means, the latter having an extension received in the cord portion of the track means. A pair of opposed end pulley means are situated at opposed ends of the track means to guide a flexible cord means which extend along the rear cord portion and is connected to the extension of the master carrier means with part of the cord means accessible for manipulation so that the master carrier means can be displaced along the track means. An elongated flexible motion transmitting means is situated in the carrier portion of the track means and is connected to all of the carrier means for transmitting movement from the master carrier means to the additional carrier means when the master carrier means is moved away from the end carrier means while freeing the master and additional carrier means for movement toward the end carrier means and closer to each other during movement of the master carrier means toward the end carrier means in response to manipulation of the cord means.

BRIEF DESCRIPTION OF DRAWINGS

The invention is illustrated by way of example in the accompanying drawings which form part of this application and in which:

FIG. 8 is a fragmentary sectional plan view taken along line 8—8 of FIG. 1 in the direction of the arrows and showing the details at the right end of the system of FIG. 1;

FIG. 9 is a transverse fragmentary sectional elvation taken along line 9—9 of FIG. 1 in the direction of the arrows and showing the details of a carrier;

FIG. 10 is a sectional plan view taken along line 10—10 of FIG. 9 in the direction of the arrows and showing further deails of a carrier;

FIG. 11 illustrates how the structure of FIG. 9 may be modified to carry a double drapery system on a single drapery track;

FIG. 12 is a schematic illustration of a center opening system;

DESCRIPTION OF PREFERRED EMBODIMENTS

Figure 3:
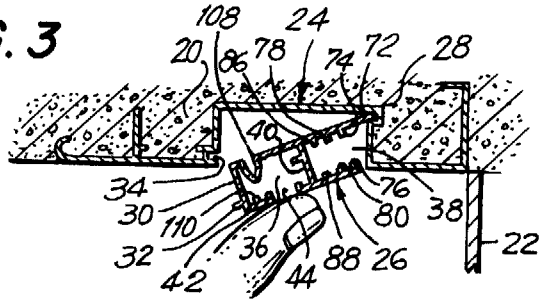
FIG. 3 is a schematic transverse sectional view of the channel and track structure illustrating how the track is snapped in the channel.

Referring first to FIG. 3, there is fragmentarily and schematically illustrated therein, in section, part of an upper wall or ceiling 20 of a room, the part which is illustrated in FIG. 3 being situated at the region of a window 22 indicated schematically at the right portion of FIG. 3. Embedded in the ceiling structure 20 is an elongated channel means 24. This elongated channel means 24 is in the form of an extrusion which extends perpendicularly to the plane of FIG. 3 along the top of the window, this channel means 24 being embedded in the cement which forms the ceiling structure 20 in the manner illustrated in FIG. 3. The configuration of the channel means 24, which may be an extrusion made of any suitable material such as a suitable metal or plastic, is such that it is capable of receiving an elongated track means 26 which is also in the form of an elongated extrusion made of any suitable metal or plastic. As is apparent from FIG. 3, the track means 26 has an upper right edge portion capable of being received in a groove 28 of the channel means. With this upper right edge portion of the track means 26 situated in the groove 28, shown in FIG. 3, it is possible for the operator to snap the track means 26 up into the hollow channel means 24, the hollow interior of which is directed downwardly as shown in FIG. 3. For this purpose the track means 26 has a left wall 30 provided with a rib 32 capable of being snapped into a groove 34 of the channel means. The metal used for the extrusion 26 is provided with a sufficient springiness so that the rib 32 can snap into the groove 34. The track means 26 has a front elongated hollow carrier portion 36 and a rear elongated hollow cord portion 38 separated from the front carrier portion 36 by a wall 40. The front hollow carrier portion 36 is formed at a lower wall 42 with a downwardly directed opening 44, so that in this way the wall 30 has sufficient yieldability to enable the rib 32 to be received in the groove 34.

Figure 2:
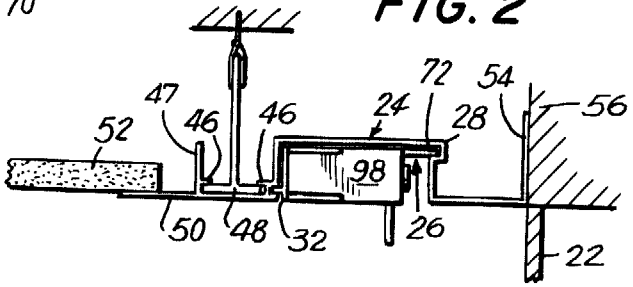
FIG. 2 is a schematic partly sectional end view taken along line 2—2 of FIG. 1 in the direction of the arrows.

In the embodiment shown in FIG. 2, the channel means 24 is identical with that of FIG. 3. However, in this case it is not embedded in cement. Instead just to the left of the hollow interior of the channel means 24, the latter has a pair of ribs 46 receiving a lower wall of a member 46 of inverted T-shaped configuration. This lower wall can be slipped between the ribs 46 and the bottom wall 50 of the channel means 24, the left free edge portion of the bottom wall 50 serving to support ceiling tiles 52. Part 47 of channel means 24 receives an unillustrated clip to lock tiles 52 in position.

Thus, the channel means 24 can be supported either in the manner shown in FIG. 2 or in the manner shown in FIG. 3. When supported in the manner shown in FIG. 2, the right upwardly extending wall 54 will be fastened in any suitable way to a structural member 56 situated over the window 52. FIG. 2 illustrates how the upper right edge of the track means 26 is received in the groove 28 as well as how the rib 32 is received in the groove 34.

Figure 1:
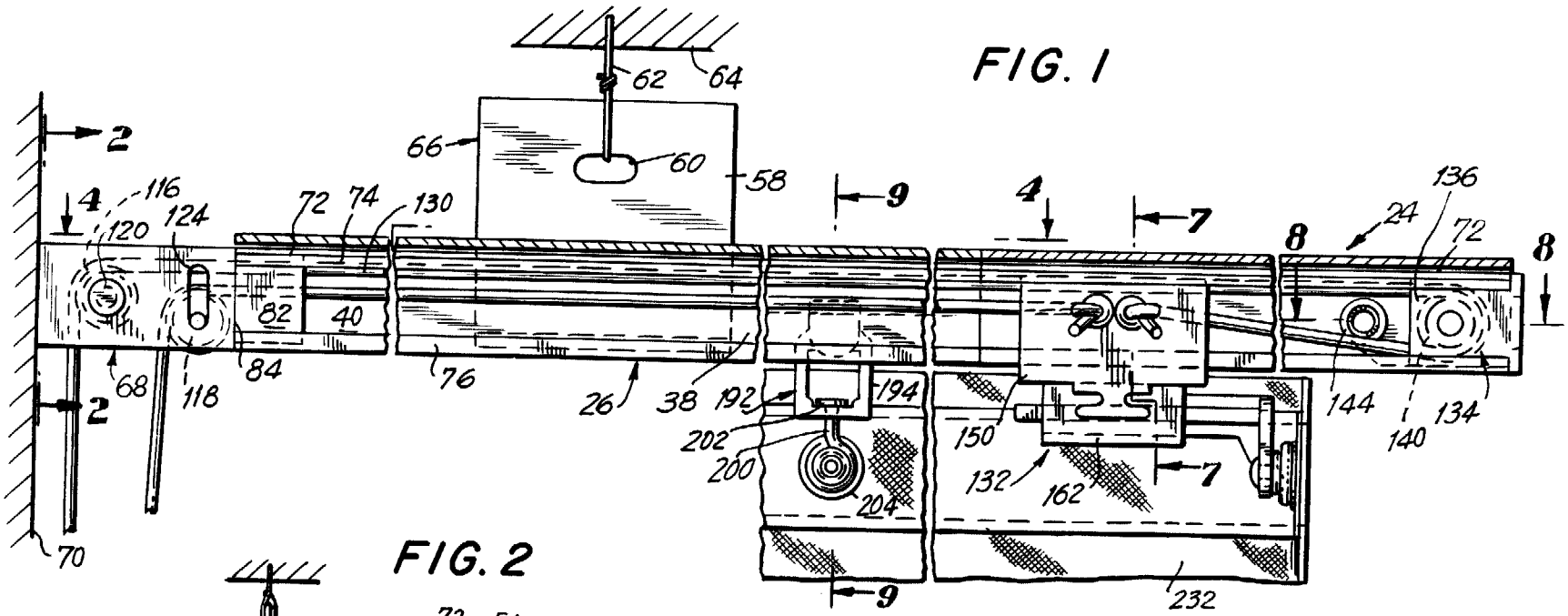
FIG. 1 is a fragmentary longitudinal sectional elevation of one embodiment of a drapery-supporting system of the invention.

The system shown in FIG. 2 is illustrated further in FIG. 1. Thus, the wall 48 is integral with and extends across a vertically extending wall 58 formed with a slot 60 receiving a suitable cable 62 or the like which is fixed to the structural member 64 situated over the false ceiling formed by the tiles 52. This cable 62 may take the form of a suitable hook embedded in structural element 64, if desired, having a lower hook portion capable of extending through the slot 60 for supporting the T-shaped channel-supporting element 66. In this way the channel means 24 can be supported in a horizontal position extending along the top of a window 22.

The elongated track means 26 carries at its left end, as viewed in FIG. 1, an end pulley means 68 the details of which are described below. This end pulley means 68 is illustrated in FIG. 1 next to a wall 70 which may be at one end of a window. FIG. 1 shows the elongated track means 26 as it appears when looking into the elongated hollow cord portion 38 thereof so that the wall 49 is visible in FIG. 1, FIG. 1 also showing the upper rear edge 72 of the track means 26, this edge 72 being received in the groove 28. Just to the left of the edge 72, as viewed in FIG. 3, the track means 26 has upper and lower ribs 74 and 76 extending toward each other and defining a rear opening which extends along the hollow cord portion 38. Just to the left of these ribs 74 and 76, the track means 26 has a pair of additional ribs 78 and 80, so that the ribs 74 and 78 form just beneath the top wall of the track means 26 one elongated groove which is situated over a second elongated groove defined between the ribs 76 and 80.

Figures 5, 6, 7, 17:
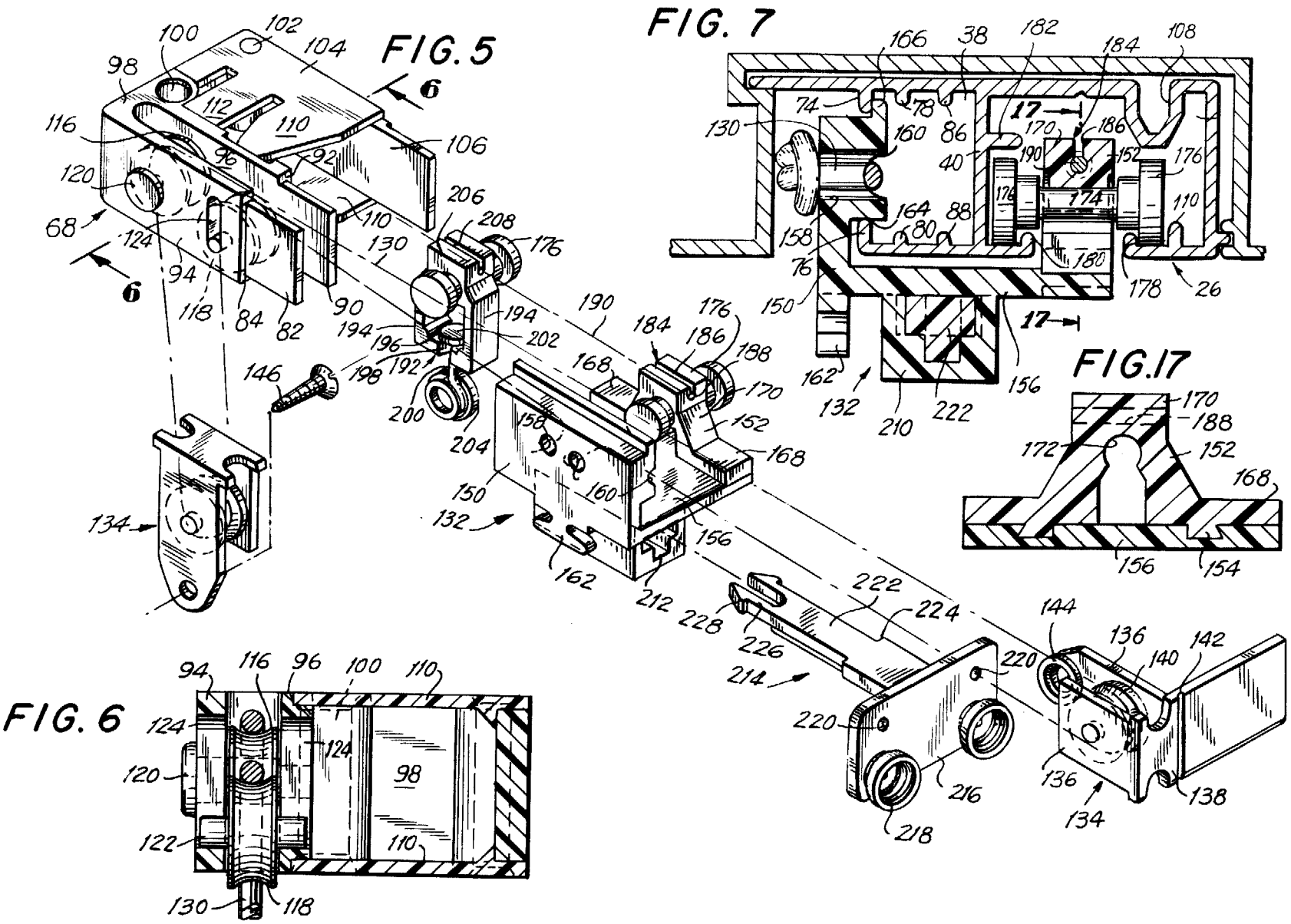
FIG. 5 is a perspective view illustrating various components of the drapery system of the invention in their operative relation with respect to each other, with some of these components being illustrated in an exploded manner.
FIG. 6 is a transverse sectional elevation of the left end pulley assembly of FIG. 5 taken along line 6—6 of FIG. 5 in the direction of the arrows.
FIG. 7 is a transverse section taken along line 7—7 of FIG. 1 in the direction of the arrows and showing details of a master carrier means supported in a track.
FIG. 17 is a transverse section of the structure of FIG. 7 showing details of the master carrier means.

The end pulley means 68 which is shown more clearly in FIG. 5 has an elongated portion 82 extending from a shoulder 84 and received at its upper edge between the ribs 74 and 78 and at its lower edge between the ribs 76 and 78. The shoulder 84 engages the left end of the track means.

Figure 4:
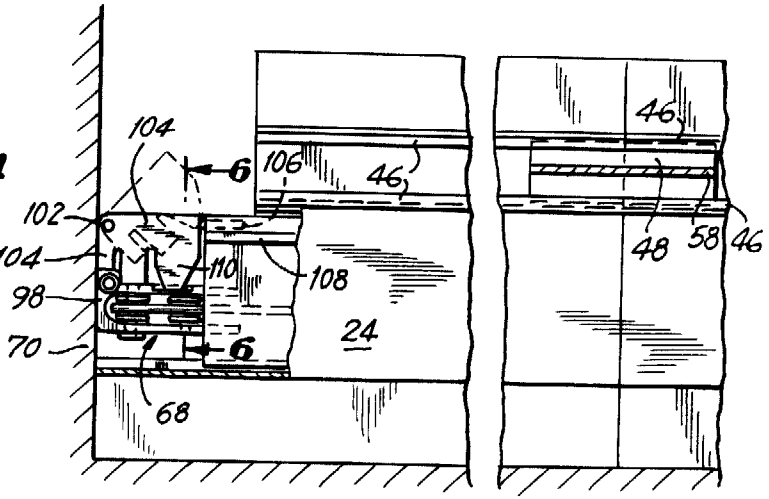
FIG. 4 is a fragmentary plan view taken along line 4—4 of FIG. 1 in the direction of the arrows.

Just to the right of the wall 40, as viewed in FIG. 3, the track means has a pair of additional upper and lower ribs 86 and 88, and these ribs define with the wall 40 a pair of upper and lower grooves which receive a second extension 90 of the end pulley means 68, this second extension 90 being parallel to the extension 82 and extending forwardly from a shoulder 92 which also engages the left end of the track means 26 as viewed in FIG. 1. These extensions 82 and 90 which are thus carried by the track means are integral with a pair of parallel walls 94 and 96 of the pulley means 68, as shown most clearly in FIG. 5. These parallel walls 94 and 96 of the end pulley means 68 are integral with an project forwardly from an end wall 98 visible in FIG. 2 and situated directly next to the wall 70 in FIG. 1. The end wall 98 extends forwardly beyond the wall 96 and has a thickened portion formed with a bore 100. Through this bore 100 it is possible to introduce a fastener by means of which the end pulley means 68 can be supported either at the wall 70 or at an upper structural element such as a part of the element 64 shown in FIG. 1. The wall 98 extends forwardly beyond the thickness portion which is formed with the vertical fastener bore 100, and at its front end region the wall 98 carries a hinge pin 102 by means of which a gate 104 is swingably connected to the wall 98 for swinging movement in the manner shown schematically in FIG. 4. This swingable gate 104 has a front extension 106. The end region of the wall 30 where the extension 106 is located is cut away so as to permit the extension 106 to pass through the cut-away portion of the wall 30, as shown most clearly in FIG. 18, and thus in the closed position of the gate 104 the part 106 can be located next to an inwardly extending part 108 of the track means 26, this inwardly extending part 108 having a substantially V-shaped cross section. Next to the wall 30 at the lower wall 42 of the track means 26 this wall 42 has an upwardly extending rib 111 (FIGS. 3 and 7) next to which the extention 106 also becomes located when the gate 104 is closed. Thus, the gate 104 can be swung to and from its closed position shown in solid lines in FIG. 4. The gate 104 is shown closed in FIG. 5 also. The gate 104 has next to the extension 106 upper and lower strengthening walls 110 which terminate in tips received in notches formed at the upper and lower edges of the wall 96. Next to the strengthening portions 100 the gate 104 has a pair of struts 112, and the lower one of these struts is adapted to extend through an end carrier means 114, as indicated most clearly in FIG. 18. The details of the carrier means 114 are described below.

The end pulley means 68 is provided with an outer pulley 116 and an inner pulley 118. The outer pulley 116 is supported for rotation on a stationary shaft which extends into suitable openings of the walls 94 and 96. Thus the stationary shaft may take the form of a headed pin having a head 120 visible in FIGS. 5 and 6, this pin extending through a central bore of the outer pulley 116 so that the latter has a stationary axis of rotation.

The inner pulley 118 is supported on a shaft 122, the ends of which are freely received in a pair of vertically extending slots 124 respectively formed through the walls 94 and 96. Thus when the end pulley means 68 is oriented in the manner shown in FIG. 5, the shaft 22 will be located at the bottom end of the slots 124 at an elevation lower than the axis of rotation of the pulley 116. On the other hand, due to the construction of the end pulley means 68 together with the gate structure which is connected thereto, this end pulley means can be inverted and situated at the right end of the track means, as viewed in FIG. 1, in which case the shaft 122 will also fall to the lower end of the slots 124 which now would be inverted as compared with their position shown in FIG. 5. Thus, in this case also the inner pulley 118 would be situated at an elevation lower than the outer pulley 116. The slots 124 extend to elevations above and below the elevation of the axis of the pulley 116. Therefore, in this way it is possible for the end pulley means 68 to be freely used at either end of the track means, and the inner pulley 118 will automatically become situated at an elevation lower than the outer pulley 116. Such an arrangement will be used in a double drape system where two drapes meet at the center of the window, and such a system is schematically illustrated in FIG. 12 where the pair of inner pulleys are both shown lower than the pair of outer pulleys in accordance with this feature of the invention.

As is shown schematically in FIG. 5, an elongated flexible cord means 130 extends around the pulleys 116 and 118. The elongated flexible cord means 130 has a pair of free ends which are fixed to a master carrier means 132 described in greater detail below. From the master carrier means 132 the elongated flexible cord means 130 extends around an end pulley means 134 shown at the right of FIGS. 1 and 5. From the end pulley means 134 the elongated flexible cord means 130 extends without interruption all the way along the interior of the rear cord portion 38 of the track means 26 up to and around the upper pulley 116 of the end pulley means 68. From the latter the flexible cord means 130 extends in the illustrated example downwardly around a pulley carried by another pulley means 134 which is identical with the end pulley means 134 at the right end of the track means as viewed in FIGS. 1 and 5. From this pulley means 134 shown at the lower left of FIG. 5 the cord 130 extends up and around the inner pulley 118 from where the cord extends again to the master carrier means 132.

The end pulley means 134 is in the form of a pair of walls 136 which are connected to each other by an end wall 138 and which support a pulley 140 for rotary movement. The wall 138 extends freely beyond the pair of walls 136 to the right, as viewed in FIG. 5, and it is formed with a line of weakness 142 which may take the form of a suitable groove or score line which is formed in the plastic of which these components such as the pair of end pulley means 68 and 134 are made. The right wall 136 shown in FIG. 5 extends beyond the left wall 136 and is formed with an eye 144.

In accordance with one of the features of the invention, the end pulley means 134 can be used in the form shown at the right of FIG. 5 when it is connected to one end of the track means 26. Thus, as is shown at the right portion of FIG. 1, the left wall 136 of FIG. 5 can be received between the upper groove formed between the ribs 74 and 78 and the lower groove formed between the ribs 76 and 89 (see also FIG. 7 in this connection). The wall 136 which has the opening 144 can be received in the space next to the wall 40 between the latter and the ribs 86 and 88. In this way the pulley 140 will be aligned with the pair of pulleys 116 and 118. The right extension of the wall 138, beyond the line of weakness 142 simply covers and closes the right free end of the track means 26.

However, when it is desired to provide a single-drape arrangement as illustrated in FIG. 5, and as will be apparent from the description which follows, the end pulley means 134 can also be used at the position of this end pulley means 134 shown at the lower left of FIG. 5. Thus for this purpose the part of the wall 138 which extends beyond the line of weakness 142 is broken off at the score line 142 to provide the structure shown at the lower left of FIG. 5. With this construction it is possible to fasten the wall 136 which has the opening 144 to a wall of the room, utilizing for this purpose a screw 146, for example. Thus, in this way the same end pulley means 134 can be used at a pair of different locations, either with or without the part of the wall 138 which extends beyond the line of weakness 142. With the end pulley means 134 fixed by the screw 146 in the manner shown at the lower left of FIG. 5, it is possible for the operator to grasp the cord 130 where it extends vertically up from the lower left end pulley means 134 shown in FIG. 5, in order to displace the master carrier means 132 in one direction or the other.

Thus, as is apparent from the above description, depending upon the type of arrangement it is possible to situate an end pulley means 68 at either one of both of the ends of the track means while the end pulley means 134 can be used also at a pair of different locations as described above, and in this way considerable economies are achieved because identical elements are used at different parts of the drapery system of the invention.

The master carrier means 132 has a rear portion 150 and a front portion 152. The front portion 152 is formed with ribs 154 of dovetail cross section received in dovetail grooves of a horizontal extension wall 156 of the rear portion 150 of the master carrier means 132. This construction is shown most clearly in FIG. 17. Thus, because of this tongue and groove connection it is possible to join the front portion 152 and the rear portion 150 of the master carrier means 132 to each other. At the same time it will be noted that the wall 156 forms an extension extending around the lower portion of the track means 26. The rear portion 150 of the master carrier means 152 is formed with the openings 158 through which an end of the cord 130 extends, this end being knotted as shown clearly in FIG. 7. Thus a pair of the openings 158 are provided with the free ends of the cord 130 extending therethrough and being knotted as shown in FIG. 7. For the purpose of guiding the cord 130, the forwardly directed surface of the part 150 is formed with a longitudinally extending groove 160 which receives the cord 130.

The rear portion 150 of the master carrier means 132 has a bottom extension 162 of T-shaped configuration extending downwardly beyond the extension wall 156.

The rear portion 150 extends through the rear opening of the rear cord portion 38 of the track means 26, in the manner shown most clearly in FIG. 7. At its part which extends through this rear opening, defined between the ribs 74 and 76, the rear portion 150 of the master carrier means 132 has a lower flat surface 164 directly resting on the top edge of the rib 76. Also, in the interior of the rear cord portion 38 of the track means 26 the rear portion 150 of the carrier means 132 has an upwardly extending lip 166 slidably engaging the inner surface of the rib 74 as shown in FIG. 7. As a result this rear portion 150 of the master carrier means 132 forms a shoe which slidably engages the track means at its ribs 74 and 76 as described above, thus providing a slidable guide for the master carrier means 132 at the rear cord portion 38.

The front portion 152 of the master carrier means 132 has between its end portions 168 which carry the dovetail ribs 154 a substantially U-shaped portion 170 formed with a groove 172 which is directed downwardly toward the wall 156 and which receives a shaft 174 which is fixed to and extends between a pair of rollers 176 of the master carrier means 132. The configuration of the groove 172 is such that the shaft 174 will snap into the groove 172 prior to joining the part 152 with the part 150 by way of the tongue and groove connection described above, although the opening beneath the groove 172 may also be made large enough to enable one of the rollers 176 to be passed through to enable the parts to be assembled even after the rear part 150 and the front part 152 of the master carrier means 132 are joined to each other. The plastic which is used for these components is springy so that the shaft 174 will readily snap into the position shown most clearly in FIG. 7.

The master carrier means 132 is assembled with the track means 26 prior to the assembly of either one or both of the end pulley means 68 and 134 with the track means. Thus, the master carrier means 132 is introduced from one end of the track means 26 with the rear portion 150 having the shoe which slidably engages the ribs 74 and 76 as described above. Simultaneously the rollers 176 are introduced into the front carrier portion of the track means. Thus it will be seen that the right roller 176 of FIG. 7 becomes situated between the rib 111 and an additional rib 178 extending along and defining one edge of the downwardly directed opening 44 of the front carrier portion 36 of the track means 26. The downwardly directed portion 108 which is hollow, as shown in FIG. 7, becomes situated directly over the roller 176 as shown at the right in FIG. 7.

The left roller 176 of FIG. 7 becomes situated between the wall 40 and a second rib 180 which extends upwardly and defines the other edge of the downwardly directed opening 44. Over this left roller 176 is an inwardly extending rib 182 which is integral with the wall 40.

By reason of the ribs 178 and 180 as well as the rib 182 and the inwardly extending hollow part 108 the rollers 176 are limited in their movement both in a direction parallel to the axis of the shaft 174 and in a direction perpendicular to this axis. Thus, while the rollers 176 are free to move along the track means, the extent to which they can be displaced from the desired path of movement is limited by these limiting portions 178, 180, 182 and 108 of the track means, thus providing an extremely reliable guide for the rollers and thus for the master carrier means 132.

The U-shaped portion 170 of the front part 152 of the master carrier means is also formed with a longitudinally extending groove 184 which has an upper narrow portion 186 and a lower wider portion 188 of circular cross section thus giving the groove 184 a substantially keyhole configuration in cross section. This groove 184 is adapted to receive an elongated flexible means 190 in the form of a cord provided with beads or knots engaging the opposed end faces of the part 152, at the opposite ends of the groove 184, so that in this way when the master carrier means 132 is displaced, the flexible means 190 will serve to transmit the movement thereof to additional carrier means.

Such an additional carrier means 192 is shown in FIG. 5 between the end pulley means 68 and the master carrier meand 132. This additional carrier means 192 has a pair of opposed side walls 194 interconnected by a bottom wall 196 formed with a notch 198 of substantially keyhold configuration capable of receiving the shank 200 of a fastener means for fastening a part of a drape to the carrier means 192. This shank 200 has an upper head end 202 resting on the top surface of the bottom wall 196 of the additional carrier means 192. At its bottom end the shank 200 is provided with an eye carrying a snap element 204 of known construction which can receive a cooperating snap element carried by a drape at an upper edge of the latter.

The additional carrier means 192 has an upper portion 206 of substantially the same configuration as the upper portion of the front part 152 of the master carrier means 132. Thus this upper portion 206 is also formed with a groove for receiving rollers 176 interconnected by a shaft 174 capable of being snapped into a groove formed in the upper portion 206 in precisely the same way as described above in connection with the master carrier means. Also, at its uppermost portion the part 206 is formed with a longitudinally extending slot 208 of keyhole cross section capable of receiving a part of the elongated flexible means 190. Thus, the cord 190 will extend through the slot 208 and it can be provided with beads or knots situated at opposed ends of the slot 208 so that in this way movement may be transmitted from the master carrier means 132 to the additional carrier means 192. Of course any desired number of these additional carrier means 192 may be provided.

Figure 18:
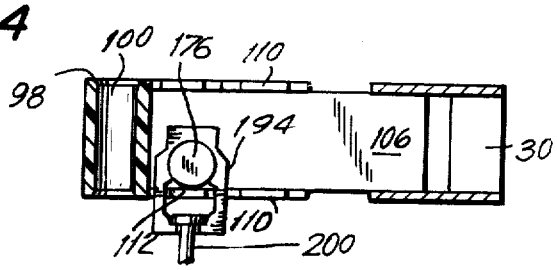
FIG. 18 is a fragmentary longitudinal partly sectional elevation of an end pulley assembly showing how an end carrier means is maintained stationary.

As is shown in FIG. 18, the end carrier means 114 corresponds in all respects to and in fact is identical with the additional carrier means 192. The strut 112 at the lower part of the gate 106 extends through the space between the side walls 194 so that in this way the end carrier means 114 which is shown in FIG. 18 is fixed. Thus, the fastener means 200 shown in FIG. 18 can be connected through snaps, for example, to one end of a drape at the upper edge of the latter thus maintaining this one end stationary while one or more additional carrier means 192 are movable between the end carrier means 114 and the master carrier means 132.

As is apparent from FIG. 7, the lower extension wall 156 of the master carrier means has an integral depending portion 210 formed with a slot 212 of T-shaped configuration extending longitudinally therethrough. It is by way of this slot 212 that it becomes possible to releasably fasten to the master carrier means an arm means to which is connected the end of the drape opposite from the end thereof which is fastened to the end carrier means 114. In the example of FIG. 5 the arm means 214 is in the form of a butt arm having an end wall 216 provided with female snap elements 218 identical with the element 204 except for the manner in which it is fastened to the wall 216. Thus the wall 216 is provided with openings 220 which receive the pins integral with and projecting from the female snap elements 218. These elements are shown in FIG. 5 fixed to a pair of lower openings 220 but if desired they could be fixed to the upper openings to fasten the drape at a higher location.

The wall 216 is integrally formed with an elongated portion 222 which has shoulders 224 to engage the end surface of the wall 156 to limit movement of the elongated portion 222 through the slot 212. This portion 222 has forwardly of its shoulders a T-shaped cross section matching that of the slot 212 so that in this way the elongated portion 222 will fit into the slot as shown most clearly in FIG. 7. The elongated portion 222 terminates in a pair of springy fingers 226 which have shoulders 228. Thus when the part 222 has been pushed into the slot 212 the springy fingers 226 will yield to become displaced toward each other until the shoulders 228 snap beyond the slot 212 in order to provide a secure connection for the butt arm 214 to the master carrier means.

Figure 13:
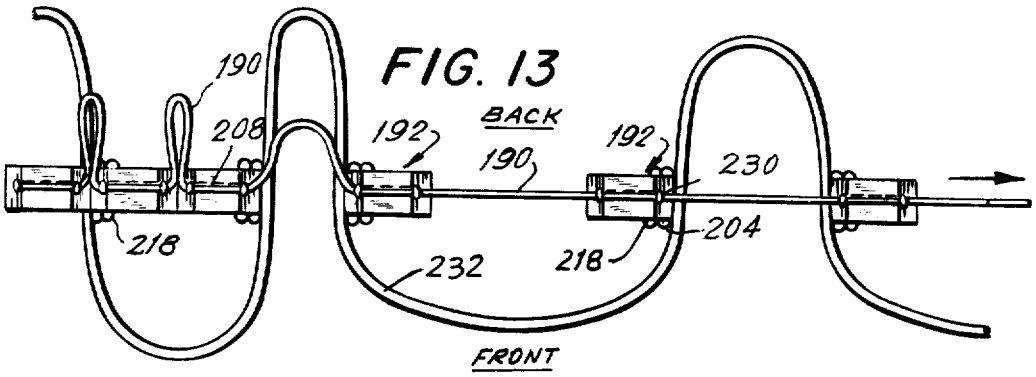
FIG. 13 is a schematic illustration of the manner in which the plurality of carrier means cooperate during opening and closing movement.

Thus, it is a simple matter with a drapery system as described above to insert by way of the gate 104 of the end pulley means 58 additional carrier means 192 which can be distributed as shown schematically in FIG. 13 where the cord 190 is illustrated extending through the grooves 208, FIG. 13 illustrating the knots or beads 230 situated at the opposite ends of the groove 208 of each additional carrier means so that movement will be transmitted from one of the additional carrier means to the other and also from the master carrier means as indicated above. Moreover FIG. 13 illustrates how the snaps 204 cooperate with additional snaps of a drape 232 which will assume a rippled condition in the manner shown in FIG. 13 when the several additional carrier means are moved toward each other, the parts of the elongated flexible means 190 which extend between adjacent additional carriers 192 being shorter than the drapery parts extending between adjacent carriers and assuming the configuration shown at the left of FIG. 13 when a number of the additional carrier means are situated one next to the other. When the gate 104 is open, an additional carrier means can readily be introduced with its rollers 176 engaging the tracks in the manner described above, and at this time the operator can easily push into the slot 208 a part of the cord 190 which extends between a pair of enlargements formed by knots or beads 230.

The connection of an additional carrier means with a drape as described above in connection with FIG. 13 is further illustrated in FIG. 9, while FIG. 10 shows how the shank 200 extends through the notch formed in the lower wall 196 of the additional carrier means 192.

FIG. 11 illustrates an arrangement according to which a double snap element is carried by the eye at the lower end of the shank 200, so that in this way a pair of overlapping drapes can be received in the double snap of FIG. 11.

FIG. 8 illustrates how the end pulley means 134 is received in one end of the track 26 as described above in connection with FIG. 5.

Figure 14:
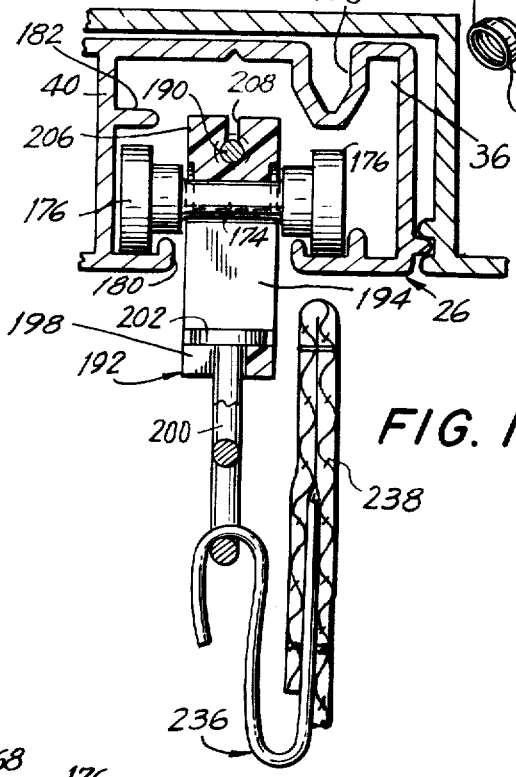
FIG. 14 is a transverse section similar to FIGS. 9 and 11 but illustrating a pin hook means for connecting a drape to a carrier.

FIG. 14 illustrates how a shank 200 may carry at its eye a curved drapery supporting pin 236 received in a conventional manner in the top end of a drape 238 as illustrated in FIG. 14. Thus, the system of the invention lends itself to all types of fastener means for fastening the additional carriers to drapes.

While in the above description, as shown particularly in FIG. 5, a single drape system has been shown, it is possible to provide a double drape system as shown schematically in FIG. 12. Thus, in this case a pair of master carrier means 132 will be utilized, the left master carrier means 132 of FIG. 12 being identical with that of FIG. 5 and being shown assembled with the butt arm means 214 as described above. It will be noted from FIG. 12 that the cord 130 also extends around the pulley means 134 fixed to a wall by a fastener 146 as described above. In the case of FIG. 12, however, a second end pulley means 134 as shown in FIGS. 5 and 8 will not be utilized. Instead a pair of the end pulley means 68 will be situated at opposite ends of the track with the inner pulleys 118 both assuming the lower elevation as described above. The right master carrier means 132 of FIG. 12 receives the cord 130 through the openings 158 as described above, but in this case the cord 130 will have a portion looped around the T-shaped lower extension 162, as shown for the right master carrier means in FIG. 12. Thus both of the master carrier means will carry the butt arms 214 as described above and arranged as shown in FIG. 12. It will be noted that the free ends of the cord 130 are fixed to the left master carrier means 132 and form part of the lower run extending between the pulleys 118 while it is the upper run of the cord 130 which extends between the upper pulleys 116 which forms the loop extending around the T-shaped portion 162 of the right master carrier means 132 of FIG. 12. By moving the loop with respect to the T-shaped portion 162 it is possible to properly center the pair of master carriers, and it is clear that when the cord is manipulated at the region of the pulley means 134, the upper and lower runs will move in one direction or the other with respect to each other so as to bring the pair of master carrier means 132 either toward each other or away from each other. Of course, additional carrier means 192 are utilized in the manner described above with the arrangement of FIG. 12.

Figure 15:
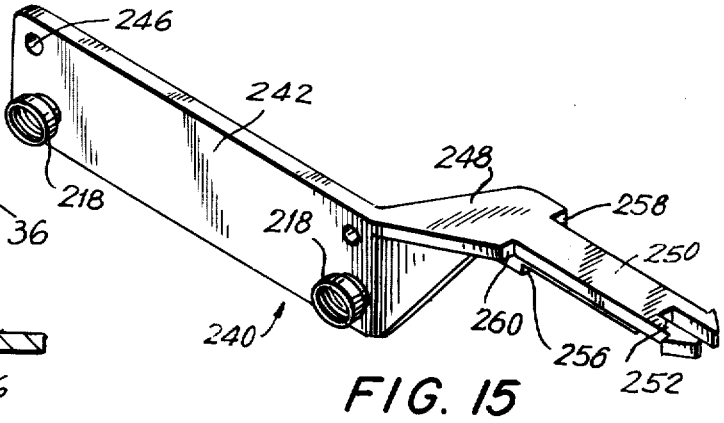
FIG. 15 is a perspective illustration of an overlap arm means.

Instead of a butt arm means 214 it is possible to use an overlap arm means 240 as illustrated in FIG. 15. This arm means 240 has a wall or plate portion 242 formed with the bores 246 which receive the pins extending from female eye elements such as the elements 218 shown in FIG. 5, and thus in this case also it is possible to connect a pair of these fastener elements either to a pair of lower bores or a pair of upper bores 246.

From the wall 246 the overlap arm means 240 has an inclined wall portion 248 which is integral with an extension 250 which terminates in the pair of springy fingers 252 which operate in the same way as the fingers 226 so as to be received in the T-shaped slot of the master carrier means at its lower portion as described above. The inclined wall 248 terminates in a pair of end shoulders 258, 260 which engage the exterior surface of the portion 210 of the master carrier means so as to limit the movement of the elongated portion 250 through the T-slot 212. It will be noted that the part 250 is integral with a pair of wall portion 256 which terminates in a shoulder which also engage an end surface of the lower extension 210 of the master carrier means.

Figure 16:
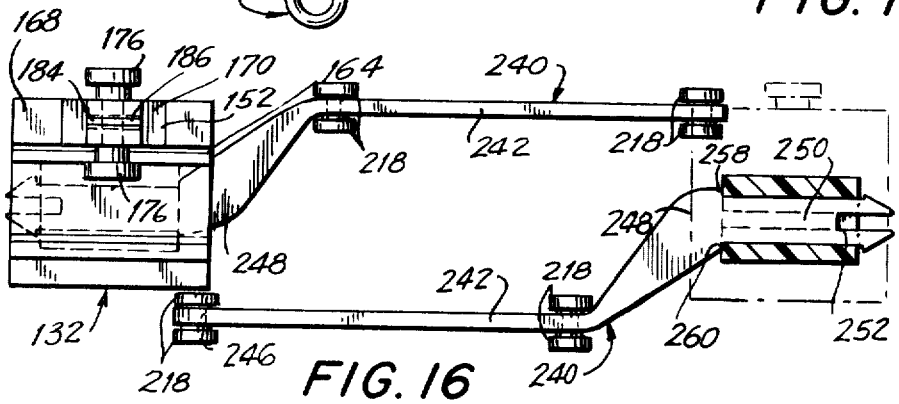
FIG. 16 is a schematic partly sectional illustration of how a pair of overlap arm means overlap each other in the closed position of a drape.

FIG. 16 illustrates how a pair of the overlap arms of FIG. 15 are carried by a pair of master carrier means. Thus, with this arrangement it is possible for the ends of a pair of drapes which are connected in a manner described above to the overlap arme means to overlap each other in the closed position of the drape.

Of course, these overlap arm means will only be used with an arrangement as shown in FIG. 12, and it is possible by adjusting the location of the loop of the cord 130 with respect to the right carrier means 132 of FIG. 12 to provide for the pair of master carrier means in the closed position of the drape a position with respect to each other which will situate the pair of overlap arm means in a manner somewhat as shown in FIG. 16.

It is apparent, therefore, that with the abovedescribed structure of the invention an inexpensive yet superior drapery system is provided.

What is claimed is:

1. In a drapery-supporting system, elongated channel means having a hollow interior adapted to be directed downwardly, elongated track means removably carried by said elongated channel means and extending into the hollow interior thereof, said elongated track means having a front longitudinally extending carrier portion formed at its lower region with a longitudinally extending opening adapted to be directed downwardly and a rear cord portion extending longitudinally along said track means behind said carrier portion thereof and having a hollow interior, said track means including a wall separating said front carrier portion from said rear cord portion thereof, a plurality of carrier means situated in said carrier portion of said track means, said track means supporting said plurality of carrier means for free movement longitudinally along said track means and said plurality of carrier means having portions extending downwardly through said opening at said lower region of said carrier portion of said track means, said plurality of carrier means respectively carrying below said track means a plurality of connecting means for connecting drapery portions to said plurality of carrier means to be carried thereby, and said plurality of carrier means including at least one end carrier means which is stationary and situated at the region of one end of said track means and at least one opposed master carrier means which is situated distant from said end carrier means with at least one additional carrier means situated between said master carrier means and said end carrier means, said master carrier means having an extension extending around a lower portion of said track means between said front carrier portion thereof and said rear cord portion thereof, said extension of said master carrier means extending into said cord portion of said track means, a pair of opposed end pulley means carried by said track means at opposed end regions of said elongated cord portion thereof, and elongated flexible cord means extending along said rear cord portion of said track means, around said pulley means, and connected to said extension of said master carrier means said flexible cord means extending downwardly from at least one of said pulley means to be accessible for manipulation, so that an operator may pull said cord means in one direction or the other for moving said master carrier means toward and away from said end carrier means, all of said carrier means respectively including roller members rotatable along said track means in response to movement of said master carrier means toward or away from said end carrier means, so that said plurality of carrier means have rolling contact with said track means, said track means including longitudinally extending limiting portions located closely adjacent to said roller members for limiting movement of said roller members in opposed directions both longitudinally and transversely of axes about which said roller members rotate, whereby said roller members are reliably maintained in engagement with said track means.

2. In a drapery-supporting system, elongated channel means having a hollow interior adapted to be directed downwardly, elongated track means removably carried by said elongated channel means and extending into the hollow interior thereof, said elongated track means having a front longitudinally extending carrier portion formed at its lower region with a longitudinally extending opening adapted to be directed downwardly and a rear cord portion extending longitudinally along said track means behind said carrier portion thereof and having a hollow interior, said track means including a wall separating said front carrier portion from said rear cord portion thereof, a plurality of carrier means situated in said carrier portion of said track means, said track means supporting said plurality of carrier means for free movement longitudinally along said track means and said plurality of carrier means having portions extending downwardly through said opening at said lower region of said carrier portion of said track means, said plurality of carrier means respectively carrying below said track means a plurality of connecting means for connecting drapery portions to said plurality of carrier means to be carried thereby, and said plurality of carrier means including at least one end carrier means which is stationary and situated at the region of one end of said track means and at least one opposed master carrier means which is situated distant from said end carrier means with at least one additional carrier means situated between said master carrier means and said end carrier means, said master carrier means having an extension extending around a lower portion of said track means between said front carrier portion thereof and said rear cord portion thereof, said extension of said master carrier means extending into said cord portion of said track means, a pair of opposed end pulley means carried by said track means at opposed end regions of said elongated cord portion thereof, and elongated flexible cord means extending along said rear cord portion of said track means, around said pulley means, and connected to said extension of said master carrier means, said flexible cord means extending downwardly from at least one of said pulley means to be accessible for manipulation, so that an operator may pull said cord means in one direction or the other for moving said master carrier means toward and away from said end carrier means, at least one of said end pulley means including a swingable gate means swingable between a closed position closing an end of said track means at said carrier portion thereof and an open position giving access to said end of said track means at said carrier portion thereof for enabling carrier means to be introduced into or removed from said carrier portion of said track means, said gate means cooperating with said end carrier means for maintaining the latter stationary with respect to said track means.

3. In a drapery-supporting system, elongated channel means having a hollow interior adapted to be directed downwardly, elongated track means removably carried by said elongated channel means and extending into the hollow interior thereof, said elongated track means having a front longitudinally extending carrier portion formed at its lower region with a longitudinally extending opening adapted to be directed downwardly and a rear cord portion extending longitudinally along said track means behind said carrier portion thereof and having a hollow interior, said track means including a wall separating said front carrier portion from said rear cord portion thereof, a plurality of carrier means situated in said carrier portion of said track means, said track means supporting said plurality of carrier means for free movement longitudinally along said track means and said plurality of carrier means having portions extending downwardly through said opening at said lower region of said carrier portion of said track means, said plurality of carrier means respectively carrying below said track means a plurality of connecting means for connecting drapery portions to said plurality of carrier means to be carried thereby, and said plurality of carrier means including at least one end carrier means which is stationary and situated at the region of one end of said track means and at least one opposed master carrier means which is situated distant from said end carrier means with at least one additional carrier means situated between said master carrier means and said end carrier means, said master carrier means having an extension extending around a lower portion of said track means between said front carrier portion thereof and said rear cord portion thereof, said extension of said master carrier means extending into said cord of said track means, a pair of opposed end pulley means carried by said track means at opposed end regions of said elongated cord portion thereof, and elongated flexible cord means extending along said rear cord portion of said track means, around said pulley means, and connected to said extension of said master carrier means, said flexible cord means extending downwardly from at least one of said pulley means to be accessible for manipulation, so that an operator may pull said cord means in one direction or the other for moving said master carrier means toward and away from said end carrier means, at least one of said end pulley means including an outer pulley having a fixed axis of rotation and an inner pulley, said one pulley means having a pair of parallel wall portions between which said outer and inner pulleys are located, said inner pulley having a supporting shaft and said wall portions respectively being formed with aligned slots extending above and below the turning axis of said outer pulley and receiving said shaft of said inner pulley so that the latter is freely movable at said shaft thereof along said slots to the lower end of the latter, so that said one pulley means can be situated at either end of said track means with said inner pulley automatically assuming an elevation lower than said outer pulley.

4. In a drapery-supporting system, elongated channel means having a hollow interior adapted to be directed downwardly, elongated track means removably carried by said elongated channel means and extending into the hollow interior thereof, said elongated track means having a front longitudinally extending carrier portion formed at its lower region with a longitudinally extending opening adapted to be directed downwardly and a rear cord portion extending longitudinally along said track means behind said carrier portion thereof and having a hollow interior, said track means including a wall separating said front carrier portion from said rear cord portion thereof, a plurality of carrier means situated in said carrier portion of said track means, said track means supporting said plurality of carrier means for free movement longitudinally along said track means and said plurality of carrier means having portions extending downwardly through said opening at said lower region of said carrier portion of said track means, said plurality of carrier means respectively carrying below said track means a plurality of connecting means for connecting drapery portions to said plurality of carrier means to be carried thereby, and said plurality of carrier means including at least one end carrier means which is stationary and situated at the region of one end of said track means and at least one opposed master carrier means which is situated distant from said end carrier means with at least one additional carrier means situated between said master carrier means and said end carrier means, said master carrier means having an extension extending around a lower portion of said track means between said front carrier portion thereof and said rear cord portion thereof, said extension of said master carrier means extending into said cord portion of said track means, a pair of opposed end pulley means carried by said track means at opposed end regions of said elongated cord portion thereof, and elongated flexible cord means extending along said rear cord portion of said track means, around said pulley means, and connected to said extension of said master carrier means, said flexible cord means extending downwardly from at least one of said pulley means to be accessible for manipulation, so that an operator may pull said cord means in one direction or the other for moving said master carrier means toward and away from said end carrier means, a flexible cord being fixed to the plurality of carrier means so that flexible portions of the latter cord extending between said plurality of carrier means can yield during movement of the plurality of carrier means toward each other while freeing the plurality of carrier means for movement apart from each other, each carrier means being formed at an upper end portion with an elongated slot, and said cord of said elongated flexible means extending into said slot and having enlargements between which the carrier means is located.

5. In a drapery-supporting system, elongated channel means having a hollow interior adapted to be directed downwardly, elongated track means removably carried by said elongated channel means and extending into the hollow interior thereof, said elongated track means having a front longitudinally extending carrier portion formed at its lower region with a longitudinally extending opening adapted to be directed downwardly and a rear cord portion extending longitudinally along said track means behind said carrier portion thereof and having a hollow interior, said track means including a wall separating said front carrier portion from said rear cord portion thereof, a plurality of carrier means situated in said carrier portion of said track means, said track means supporting said plurality of carrier means for free movement longitudinally along said track means and said plurality of carrier means having portions extending downwardly through said opening at said lower region of said carrier portion of said track means, said plurality of carrier means respectively carrying below said track means a plurality of connecting means for connecting drapery portions to said plurality of carrier means to be carried thereby, and said plurality of carrier means including at least one end carrier means which is stationary and situated at the region of one end of said track means and at least one opposed master carrier means which is situated distant from said end carrier means with at least one additional carrier means situated between said master carrier means and said end carrier means, said master carrier means having an extension extending around a lower portion of said track means between said front carrier portion thereof and said rear cord portion thereof, said extension of said master carrier means extending into said cord portion of said track means, a pair of opposed end pulley means carried by said track means at opposed end regions of said elongated cord portion thereof, and elongated flexible cord means extending along said rear cord portion of said track means, around said pulley means and connected to said extension of said master carrier means, said flexible cord means extending downwardly from at least one of said pulley means to be accessible for manipulation, so that an operator may pull said cord means in one direction or the other for moving said master carrier means toward and away from said end carrier means, said master carrier means removably carrying an arm means for supporting an end of a drape, and said arm means having a removable springy connection with said carrier means, said master carrier means being formed with a slot extending longitudinally therethrough and said arm means having a pair of springy fingers capable of being inserted through said slot and releasably retained therein for removably connecting said arm means with said master carrier means.

6. The combination of claim 5 and wherein said arm means is a butt arm means having an end wall which extends perpendicularly with respect to said track means.

7. The combination of claim 5 and wherein said arm means is an overlap means having an elongated drapery-carrying portion extending parallel to said track means.

8. The combination of claim 7 and wherein there are a pair of said master carrier means respectively carrying a pair of said overlap arm means which overlap each other when a drapery carried thereby is closed, said elongated cord means having upper and lower runs respectively connected with the pair of master carrier means for simultaneously moving the latter in opposite direction either away from or toward each other when said cord means is moved in one direction or the other.

* * * * *